US007777475B2

(12) United States Patent
Sperling et al.

(10) Patent No.: US 7,777,475 B2
(45) Date of Patent: Aug. 17, 2010

(54) POWER SUPPLY INSENSITIVE PTAT VOLTAGE GENERATOR

(75) Inventors: Michael A. Sperling, Poughkeepsie, NY (US); Paul D. Muench, Poughkeepsie, NY (US); George E. Smith, III, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 277 days.

(21) Appl. No.: 12/021,484

(22) Filed: Jan. 29, 2008

(65) Prior Publication Data

US 2009/0189591 A1 Jul. 30, 2009

(51) Int. Cl.
*G05F 3/16* (2006.01)
*G05F 3/26* (2006.01)

(52) U.S. Cl. ..... 323/314; 323/316

(58) Field of Classification Search ..... 323/311, 323/312, 313, 314, 315, 316
See application file for complete search history.

(56) References Cited

U.S. PATENT DOCUMENTS

| | | | | |
|---|---|---|---|---|
| 6,292,050 | B1 | 9/2001 | Dooley et al. | |
| 6,323,628 | B1 | 11/2001 | Park | |
| 6,900,689 | B2 | 5/2005 | Kimora | |
| 7,113,025 | B2 | 9/2006 | Washburn | |
| 7,119,527 | B2 | 10/2006 | Fernald | |
| 7,268,529 | B2 * | 9/2007 | Mochizuki et al. | 323/316 |

* cited by examiner

*Primary Examiner*—Gary L Laxton
(74) *Attorney, Agent, or Firm*—William A. Kinnaman, Jr.

(57) ABSTRACT

A method and apparatus for generating a voltage that is proportional to an absolute temperature (PTAT voltage). A current generator for generating a current that is proportional to absolute temperature (PTAT current) has an internal resistance and two diodes. The PTAT current is proportional to the resistance, and the temperature coefficient of the PTAT current is defined by the ratio of diode current densities. A feedback circuit has a source follower that is connected to the current generator for driving the output node with a regulated PTAT current wherein the PTAT current is mirrored accurately, providing a constant Vref.

16 Claims, 1 Drawing Sheet

POWER SUPPLY INSENSITIVE PTAT VOLTAGE GENERATOR

FIELD OF THE INVENTION

This invention relates to analog circuitry and particularly to reference voltages generators that are proportional to absolute temperature (hereafter PTAT).

BACKGROUND OF THE INVENTION

Conventional PTAT voltage generators employ a diode-based bandgap to provide a current that was independent of any process variation and had a positive temperature coefficient. This current was mirrored using P-type transistors into a resistor string, which yielded a voltage that had the same positive voltage coefficient as the current. Since the voltage across the diode and the resistance value of the resistor do not track during manufacturing there is a mismatch in the drain voltages between the two P-type transistors. Thus, the current is not properly mirrored and some error is introduced.

U.S. Pat. No. 6,900,689 to Kimura discloses a Complementary MOS (CMOS) reference voltage circuit, formed on a semiconductor integrated circuit that outputs a reference voltage having a temperature-independent characteristic. The circuit included a first and second diode-connected transistors (or diodes), respectively grounded and driven with two constant currents bearing a constant current ratio to each other. An amplifying unit which included a differential voltage of output voltages from the first and second transistors by a preset factor and for summing the amplified differential voltage to an output voltage of the first or second transistor. The amplifying and summing unit included two operational amplifiers (OTAs) and a current mirror circuit. The first OTA is fed with the differential voltage and the second OTA has a reverse phase input terminal fed with an output voltage from the first or second transistor and a forward phase input terminal connected to its output terminal and driven with a current proportional to an output current of the first OTA, with an output terminal voltage of the second OTA being used as an output voltage. Accordingly, the CMOS reference voltage circuit comprised a first and second diode-connected transistors (or diodes), which are grounded, and are driven respectively by two constant currents, bearing a constant current ratio, and means for amplifying a differential voltage between output voltages of the first and second diode-connected transistors (or diodes) by a predetermined constant factor and summing the resulting amplified voltage to an output voltage of the first or second diode-connected transistor (or diode), in which said means for amplification and summation includes first and second operational transconductance amplifiers (OTAs) and a current mirror circuit, in which the first OTA is fed with the differential voltage, the second OTA has a first input terminal(−) fed with an output voltage from the first or second diode-connected transistor (or diode) and a second input terminal(+) connected to an output terminal and driven with a current proportional to the output current of said first OTA, an output terminal voltage of the second OTA being an output reference voltage.

U.S. Pat. No. 6,323,628 to Park disclosed a voltage regulator that establishes a bandgap voltage reference and achieves output voltage regulation with a single feedback loop. The bandgap voltage reference is established by equal current flow through each of two branches of a proportional to absolute temperature current mirror. The equal current flow through the two branches of the proportional to absolute temperature current mirror is achieved by the feedback loop controlling the current flow in response to the bandgap voltage reference. This same feedback loop, responsible for establishing the bandgap voltage, also establishes the regulated output voltage through a pass transistor by means of maintaining a fixed voltage ratio between the bandgap voltage and the regulated output voltage through a resistor string . . . Accordingly, the voltage regulator included a proportional to absolute temperature current mirror having first and second current branches for establishing a bandgap voltage when current flow through the first and second current branches is equal and a resistor string coupled to the proportional to absolute temperature current mirror and responsive to the bandgap voltage for developing a regulated voltage from the bandgap voltage that is supplied to a load. Also included in this voltage regulator are output means between the proportional to absolute temperature current mirror and the resistor string for supplying output current to the load while maintaining the regulated voltage constant and an inverting gain stage coupled to the proportional to absolute temperature current mirror for sensing relative current flow through the first and second current branches in the proportional to absolute temperature current mirror and for controlling the output means to maintain the regulated voltage constant.

The conventional prior art PTAT circuits introduce errors because the current was not properly mirrored.

SUMMARY OF THE INVENTION

The shortcomings of the prior art PTAT circuits by introducing errors because the current was not properly mirrored is overcome by the present invention. Additional advantages are provided through the provision of a feedback circuit and a source follower. The circuit can guarantee that the current is mirrored identically regardless of the value of power supply voltage. This added circuitry is easy to implement and is low in both power and area. The essence of this invention is that the PTAT circuit allows a large range of operation including low voltage about 1 Volt and more accurate temperature readings. Accordingly, the present invention is a simple solution which provides better measurement accuracy of the chip temperature with low power and area overhead Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
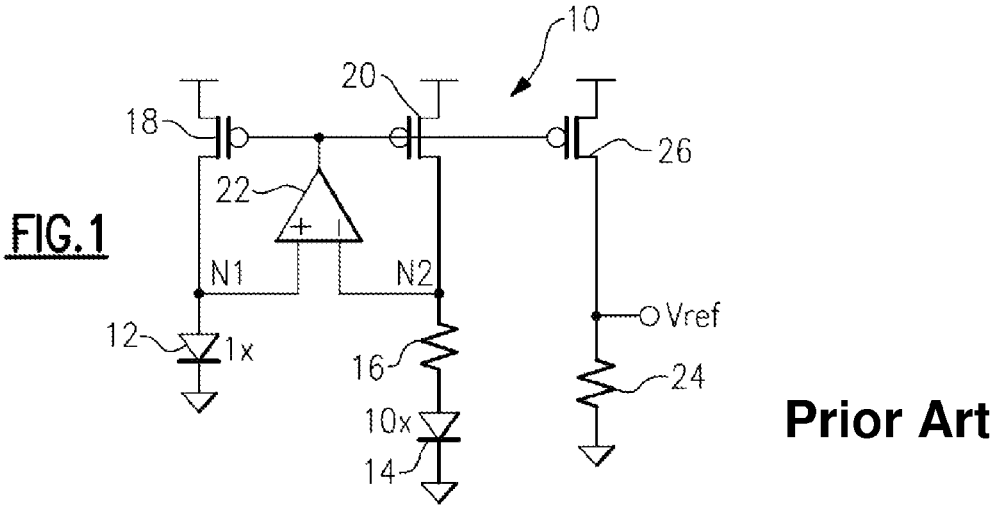
FIG. 1 illustrates a conventional prior art PTAT voltage reference.

Turning now to the drawings in greater detail, it will be seen that FIG. 1 illustrates a schematic of a conventional prior art bandgap generator circuit 10. These types of bandgap generator circuits are well known in the prior art. A first diode 12 is connected to node N1 and ground. A second diode 14 connected to ground and resistor 16 which are connected to node N2 . . . A first P-type transistor current source 18 is connected between node N1 and Vpp. A second P-type transistor current source 20 which is mirrored with P-type transistor 18 and drives the resistor 16 and diode 14. An operational amplifier 22 has one input thereof connected to node N1 and one input is connected to node N2. The output of operational amplifier 22 is operable to vary currents through current sources 18 and 20.

An output leg that is provided with resistor 24 is connected between ground and an output Vref. A third P-type transistor current source 26 is connected between Vdd and output Vref while resistor 24 is connected from Vref to ground. It is well known in the art that if two diodes are operating at different current densities the voltage difference between them will be directly proportional to the absolute temperature. The operational amplifier 22 provides feedback such that nodes N1 and N2 are equal in value. Thus, the voltage difference between the two diodes 12 and 14 will appear across resistor 16. In accordance with known principles of physics of semiconductor devices this voltage across resistor 16 will be proportional to the ratio of the sizes between the two diodes. This is fairly constant even through process variations. This PTAT current will be mirrored to resistor 24 thru the P-type current sources 18, 20 and 26. Thus, the PTAT current flow through resistor 24 will generate a PTAT voltage at Vref. In summary, FIG. 1 illustrates a conventional PTAT voltage band gap reference circuit 10 which has a bandgap circuit composed of two diodes operating at different current densities. The voltage difference appears across a resistor, defining a current which is proportional to the absolute temperature. This current is then mirrored to a second resistor, generating a PTAT voltage at Vref.

Figure 2:
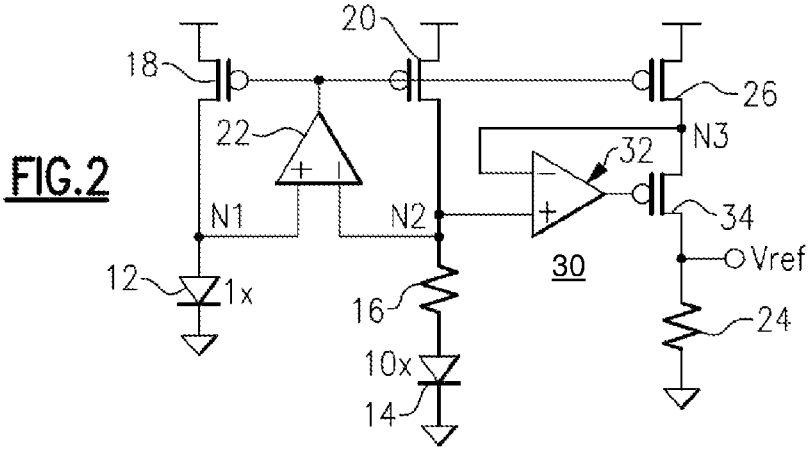
FIG. 2 illustrates one example of the present invention, including the feedback loop and source follower transistor.

FIG. 2. illustrates the present invention where a source follower feedback circuit 30 has been added to the output leg between node N3 and resistor 24 The source follower feedback circuit 30 includes an operational amplifier 32 which has one input connected to node N2 and the other input connected to Node N3. The output of operational amplifier 32 is operable to vary the gate voltage of a fourth P-type transistor current source follower 34. It will be seen that in FIG. 2 a feedback loop has been added thru an additional operational amplifier and source follower P-type transistor. This feedback loop ensures that the drain voltage on every P-type current source transistor is identical and thus the current is mirrored exactly. Specifically, Nodes N1, N2 and N3 will be identical in value . . .

The operational amplifier 32 will sense the voltage at node N2 and adjust the gate voltage of P-type source follower transistor 34 such that the voltage at node N3 will be equal to N2. When these two voltages are equal in value current sources 20 and 26 will provide the exact same current since they are functioning at exactly the same operating point. That is to say the gate, source and drain of these two transistors, 20 and 26, are mirrored perfectly. So, the PTAT current will mirror perfectly, providing a constant Vref regardless of the power supply or process variation. Without this improvement the drain of transistor 26 may be a different voltage than the drain of transistor 20, creating a situation where they are not at the same operating point. Therefore, they will not mirror the current perfectly. This design will function down to the point where the forward voltage of the diode plus the drain to source saturation voltage of a P type transistor is equal to the power supply. This will be approximately 1 Volt or less in modern processes. The upper level will be set by the maximum drain to source voltage allowed across a P-type device since the feedback circuits will compensate for all power supply changes.

Figure 3:
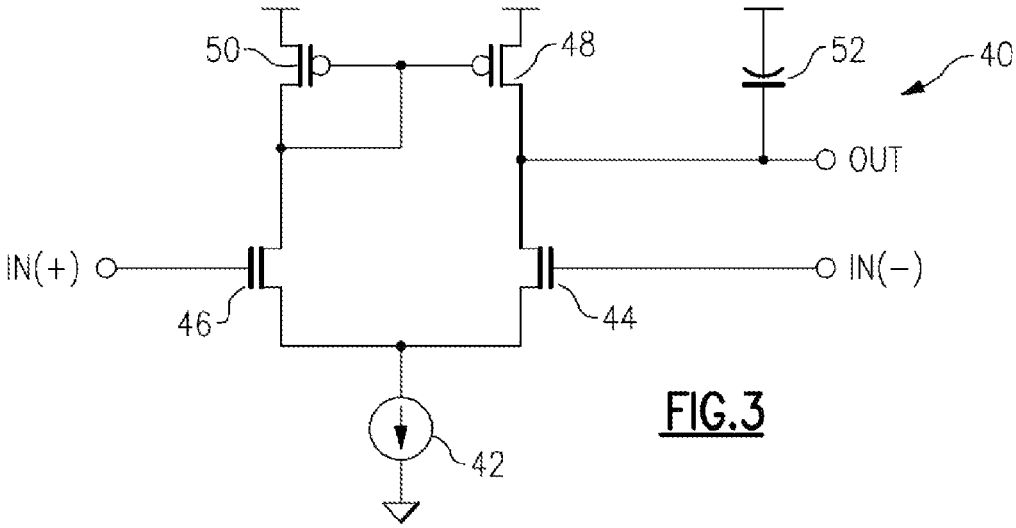
FIG. 3 illustrates an example of an operational amplifier that may be used in the present invention.

FIG. 3. illustrates one example of an operational amplifier that may be used in the present invention. It is composed of current source 42 connected to the sources of N type transistors 44 and 46. The gate of transistor 44 is connected to the negative input of the amplifier 40 while the gate of transistor 46 is connected to the positive input of the amplifier 40. The drains of transistors 44 and 46 are connected respectively to the sources of P-type load transistors 48 and 50. The gates of these P-type transistors are tied together and set to the drain of transistor 46 in order to set an operating point and provide gain at the output Out. Capacitor 52 provides stability to the loop when the amplifier is placed in negative feedback. This structure is well established in the literature.

As one example, one or more aspects of the present invention can be included in an article of manufacture (e.g., one or more computer chip products) having, for instance, on-chip temperature sensors. The sensors have embodied therein, for instance, hardware and/or computer readable program code means for providing and facilitating the capabilities of the present invention. The article of manufacture can be included as a part of a computer system or sold separately.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A voltage reference generator, comprising:

a current generator for generating a current that is proportional to absolute temperature (PTAT current), the current generator having an internal resistance and two diodes, wherein the PTAT current is proportional to the resistance and the temperature coefficient of the PTAT current is defined by the ratio of diode current densities;

an output node; and a feedback circuit having a source follower that is connected to the current generator for driving the output node with a regulated PTAT current wherein the PTAT current is mirrored accurately, providing a constant Vref.

2. The voltage reference of claim 1, wherein the feedback circuit includes an operational amplifier to measure the difference between two drain voltages and correct that difference.

3. The voltage reference of claim 2, wherein the source follower is connected to the output node of the operational amplifier to set the voltage at the drain of a P-type transistor.

4. The voltage reference of claim 2, wherein the operational amplifier is a differential amplifier.

5. The voltage reference of claim 4, wherein the differential amplifier has a differential pair of N-type transistors with P-type loads.

6. The voltage reference of claim 2, wherein the source follower is connected to the output node of the operational amplifier to set the voltage at the drain of a P-type transistor, and the operational amplifier is a differential amplifier.

7. The voltage reference of claim 6, wherein the differential amplifier has a differential pair of N-type transistors with P-type loads.

8. The voltage reference of claim 1, wherein the source follower is connected to the output node of an operational amplifier to set the voltage at the drain of a P-type transistor.

9. The voltage reference of claim 8, wherein the operational amplifier is a differential amplifier.

10. The voltage reference of claim 9, wherein the differential amplifier has a differential pair of N-type transistors with P-type loads.

11. The voltage reference of claim 8, wherein the feedback circuit includes the operational amplifier to measure the difference between two drain voltages and correct that difference.

12. A method for generating a voltage that is proportional to an absolute temperature (PTAT voltage) having the steps comprising:

providing a current generator for generating a current that is proportional to absolute temperature (PTAT current), the current generator having an internal resistance and two diodes, wherein the PTAT current is proportional to the resistance and the temperature coefficient of the PTAT current is defined by the ratio of diode current densities; and providing a feedback circuit having a source follower that is connected to the current generator for driving an output node with a regulated PTAT current wherein the PTAT current is mirrored accurately, providing a constant Vref.

13. The method of claim 12 which includes measuring the difference between two drain voltages and correcting that difference using an operational amplifier within the feedback circuit.

14. The method of claim 13 which includes setting the voltage at the drain of a P-type transistor by connecting the source follower to the output node of the operational amplifier.

15. The method of claim 14 in which the operational amplifier is a differential amplifier.

16. The method of claim 15 in which the differential amplifier has a differential pair of N-type transistors with P-type loads.

* * * * *